US007665336B2

(12) United States Patent
Widén

(10) Patent No.: US 7,665,336 B2
(45) Date of Patent: Feb. 23, 2010

(54) LOCK AND KEY SYSTEM WITH EXTRA CODE COMBINATIONS

(75) Inventor: Bo Widén, Torshälla (SE)

(73) Assignee: Winloc AG, Zug Schweiz (CH)

( * ) Notice: Subject to any disclaimer, the term of this patent is extended or adjusted under 35 U.S.C. 154(b) by 254 days.

(21) Appl. No.: 11/294,495

(22) Filed: Dec. 6, 2005

(65) Prior Publication Data

US 2006/0207304 A1 Sep. 21, 2006

(30) Foreign Application Priority Data

Mar. 18, 2005 (SE) ..... 0500624-2

(51) Int. Cl.
*E05B 19/06* (2006.01)
*E05B 27/10* (2006.01)

(52) U.S. Cl. ..... 70/409; 70/494; 70/495

(58) Field of Classification Search ..... 70/409, 70/492–495, 378, 392
See application file for complete search history.

(56) References Cited

U.S. PATENT DOCUMENTS

| | | | | | |
|---|---|---|---|---|---|
| 4,635,455 | A | | 1/1987 | Oliver | |
| 4,756,177 | A | | 7/1988 | Widen | |
| 4,815,307 | A | | 3/1989 | Widen | |
| 5,067,335 | A | | 11/1991 | Widen | |
| 5,715,717 | A | * | 2/1998 | Widen | 70/493 |
| 5,809,816 | A | * | 9/1998 | Widen | 70/493 |
| 5,845,525 | A | * | 12/1998 | Widen | 70/493 |
| 6,134,929 | A | * | 10/2000 | Widen | 70/493 |
| 7,159,424 | B2 | * | 1/2007 | Widen | 70/409 |
| 2005/0061043 | A1 | | 3/2005 | Widen | |
| 2007/0051147 | A1 | * | 3/2007 | Widen | 70/409 |

* cited by examiner

*Primary Examiner*—Lloyd A Gall
(74) *Attorney, Agent, or Firm*—Birch, Stewart, Kolasch & Birch, LLP

(57) ABSTRACT

A lock and key system with a very large number of code combinations. The lock (200) includes side locking tumblers (206) having pivoting fingers (208) with asymmetric key contacting portions (220*r*), which engage with a wave-like code pattern (105) formed at the side of the key (100).

24 Claims, 6 Drawing Sheets

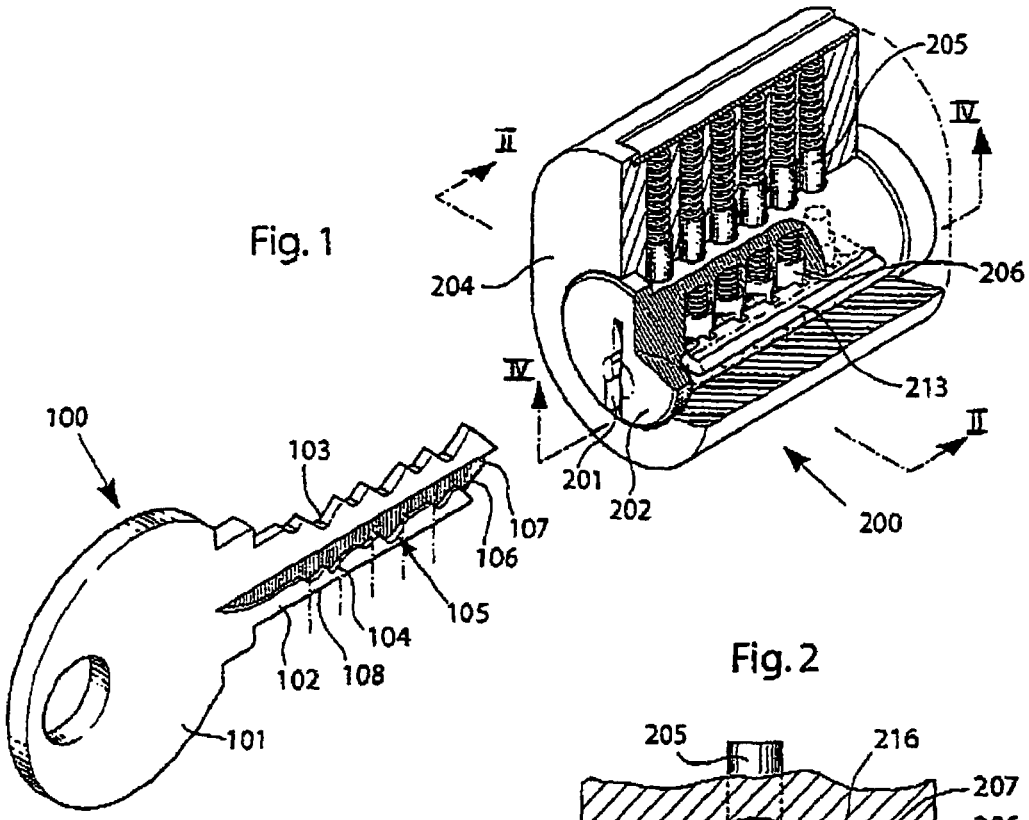
Fig. 1
Fig. 2
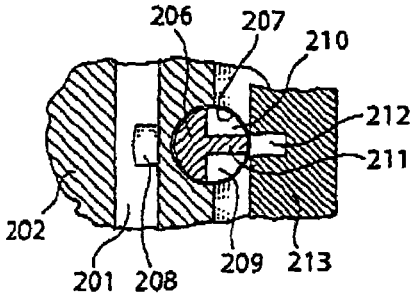
Fig. 3
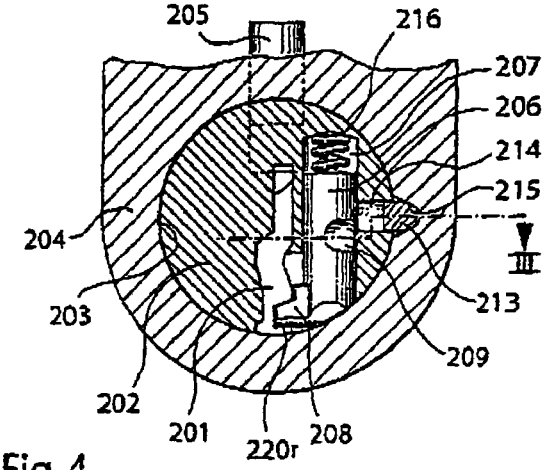
Fig. 4
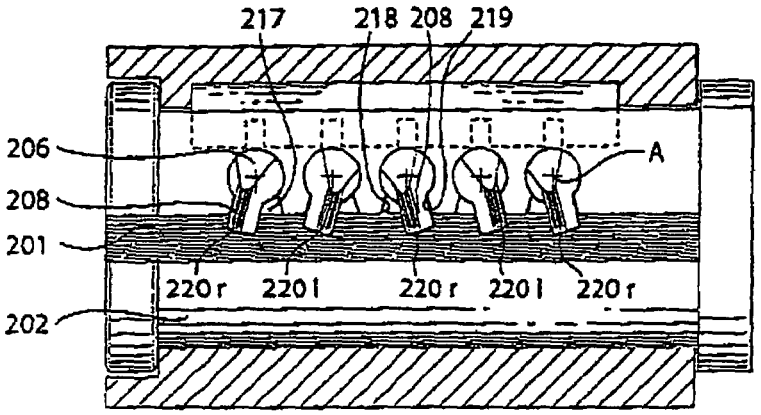

LOCK AND KEY SYSTEM WITH EXTRA CODE COMBINATIONS

FIELD OF THE INVENTION

The present invention relates to a high security lock and key system with a very large number of code combinations. The system is of the kind where the blade of the key has a wave-like guiding surface at the side of the key blade which, upon insertion into an associated lock having a rotatable key plug, engages with one or more side locking tumblers cooperating with a side locking mechanism for locking the key plug against rotation. Such lock and key systems are generally known from the U.S. Pat. Nos. 4,756,177 and 5,715,717 (both in the name of Bo Widén).

The invention also relates to a key or a key blank as such, a method of manufacturing such keys, a lock as such and a side locking tumbler, for use in such a system.

More particularly, the present lock and key system includes locks of the kind comprising:

- a housing having a cylindrical bore,
- a cylindrical key plug being rotatably journalled in said cylindrical bore, said key plug having a longitudinal key slot and, at a side of said key slot, a number of side locking tumblers in a row cooperating with a side locking means for locking the key plug against rotation in the cylindrical bore,
- at least one of said side locking tumblers comprising a cylindrical body portion being mounted in an associated chamber for elevational and rotational movement therein, and a finger which projects transversely from said body portion,
- said elevational movement being performed against the action of a force exerted along said chamber, and
- said rotational movement of the side locking tumblers being caused by a pivotal motion performed by the associated finger, the rotational movement of the side locking tumbler being limited between two angular positions corresponding to a respective pivotal end position of the finger, and including keys of the kind comprising:

- a longitudinally extending key blade, which is insertable into said key slot of the key plug of an associated lock,
- said key blade having at a side thereof a side code pattern which forms a wave-like guiding surface including a ramp surface portion at the free end portion of the key blade,
- said wave-like guiding surface engaging with said finger of said at least one side locking tumbler and making the latter follow said wave-like guiding surface,
- the side locking tumbler being caused to move elevationally while being acted upon by said force and the finger being caused to pivot sideways into a specific pivotal position, when the key blade is inserted into the key slot.

BACKGROUND OF THE INVENTION

Such lock and key systems of the kind known from the above mentioned U.S. patents (Bo Widén) provide a high level of security as compared to conventional systems without rotatable tumblers and pivoting fingers thereon. A great number of code combinations can be achieved, and the locks are very difficult to pick or manipulate. The tumblers are only partially visible in the key slot, and their correct elevational and pivotal code positions are hidden from inspection through the key slot. Therefore, the particular code positions cannot be determined from just observing the key slot or even by sensing the finger positions with a tool.

The side code portions of the wave-like guiding surface (sometimes also called side bittings) of the key blade of the previously known key are each constituted by a concavity surface portion having two upwardly sloping surface portions adjoining smoothly on each longitudinal side thereof. It has also been suggested, in a pending international application PCT/SE04/001312 (WINLOC AG), to locate some of the side code portions at an uppermost vertical code level where the guiding surface is substantially flat.

The possible side code portions associated with a particular side locking tumbler for a code structure involve different combinations of predetermined vertical levels and a number of longitudinal positions in relation to the side locking tumbler. In a typical system, which has been in commercial use for many years, the number of side tumblers is five (in addition to six centrally located tumblers cooperating with an upper edge of the key blade). The side material region, where the wave-like guiding surface or side bitting is cut at the side of the key blade, has a relatively small height (perpendicularly to the longitudinal direction of the key blade), such as about 2.0 mm (about 0.080 inches). Therefore, only a limited number of vertical levels can be accommodated while clearly differentiating between different codes, in particular two such levels, 0.60 mm (0.024 inches) and 1.20 mm (0.048 inches), respectively, calculated from the bottom edge of the key blade.

Such differentiated levels pertain to a particular pivotal position of the finger of the associated side locking tumbler. In the embodiments used hitherto, there are two vertical levels corresponding to each pivotal end position of the finger (at a pivotal angle of +15° and −15°), two further levels corresponding to an intermediate pivotal position (at a pivotal angle of 0°), each being slightly higher than the first-mentioned levels, viz. 0.90 mm (0.036 inches) and 1.50 mm (0.060 inches), respectively, and the above-mentioned uppermost level constituting another code position, possibly irrespective of the specific pivotal position of the tumbler finger.

Accordingly, for each side locking tumbler in the example above, there are seven possible codes, viz.

- two code portions at different vertical levels corresponding to a pivotal end position at +15°,
- two code portions at different vertical levels corresponding to a pivotal end position at −15°,
- two code portions at different, slightly higher vertical levels corresponding to an intermediate pivotal position,
- and a further code portion at the uppermost vertical level, making a total of seven possible code portions for each side locking tumbler or a total of $7\times7\times7\times7\times7=16807$ different combinations.

Of course, it would be desirable to increase this high number of combinations even further. However, the dimensions of the keys are greatly standardized and also adapted to existing manufacturing facilities. In practice, there is virtually no possibility to pack the vertical levels closer together, or to use more than three different pivotal positions. Therefore, it appears necessary to find some other way to increase the number of code combinations.

OBJECT OF THE INVENTION

Against this background, a main object of the present invention is to provide a lock and key structure with an even higher number of possible code combinations, while preserving the overall dimensions of the locks and the keys of the system. A further object is to enable a highly controlled manufacture of keys and key blanks, so that the users of the lock and key system can remain confident that a particular key is unique and cannot be readily duplicated by unauthorised persons.

Other objects are to further increase the level of security against picking and manipulation, to safeguard a good locking action, and to provide for master keying.

SUMMARY OF THE INVENTION

The main object is achieved for a cylinder lock and key system having the features stated in claim 1. Accordingly, the transversely projecting, pivoting finger of at least one, some or all of the side tumblers are provided with a base portion having two opposite side surfaces located at a mutual distance being substantially smaller than the distance between two associated surfaces in a channel extending from said tumbler chamber to said key slot, so as to enable a pivoting motion of the finger between said two pivotal end positions, and an asymmetrical free end portion having a key contacting portion which is displaced in a circumferential or transversal direction, relative to a central plane extending through the central axis of the cylindrical body portion and centrally through the base portion of the finger, whereby the location of the key contacting portion is superposed by way of a specific pivotal position of the finger and a specific asymmetric displacement of the key contacting portion, and the number of possible code combinations is consequently further increased.

In this way, the number of code combinations is increased even further, since each specific code location is multiplied by two or three, corresponding to the possible locations of the key contacting portion in relation to said central plane, either symmetrically in the central plane or asymmetrically at either side thereof.

So, there is a superposition of the specific location of the key contacting portion at the free end of the tumbler finger, viz. two or three positions superimposed on each pivotal position. Hereby, in practice, the number of possible code combinations will be more than 50,000, theoretically more than 500,000 or even higher. This is achieved while still safe-guarding a good locking action.

Of course, the number of possible code combinations may be multiplied further by large factor, in case the key blade is provided with at least one additional code pattern, e.g. at the upper edge of the key blade. Then, the total number of code combinations may increase up to 10,000,000 or even higher.

In order to facilitate a pivotal movement of each tumbler finger, the base portion of the finger has preferably a limited width which is smaller than the diameter of the cylindrical body portion.

Other advantageous features of the lock and key system, the lock, including a special side locking tumbler, the key blade or key blank, and a method of manufacturing such a key are stated in the claims and will appear from the following detailed description.

BRIEF DESCRIPTION OF THE DRAWINGS

The invention will now be described more fully with reference to the attached drawings which illustrate some preferred embodiments of the lock and key system according to the invention.

FIG. 1 shows, in a perspective view, a key and a cylinder lock, the latter being partially cut away for greater clarity;

FIG. 2 shows a partial cross-section through the lock along the line II-II in FIG. 1;

FIG. 3 shows a cross-sectional portion of the lock, in particular a side locking tumbler seen from above, along the line III in FIG. 2;

FIG. 4 shows, in a view from below along the line IV-IV in FIG. 1, the various side locking tumblers which are each provided with a transversely projecting, pivoting finger;

DETAILED DESCRIPTION OF SOME PREFERRED EMBODIMENTS

Figure 5:
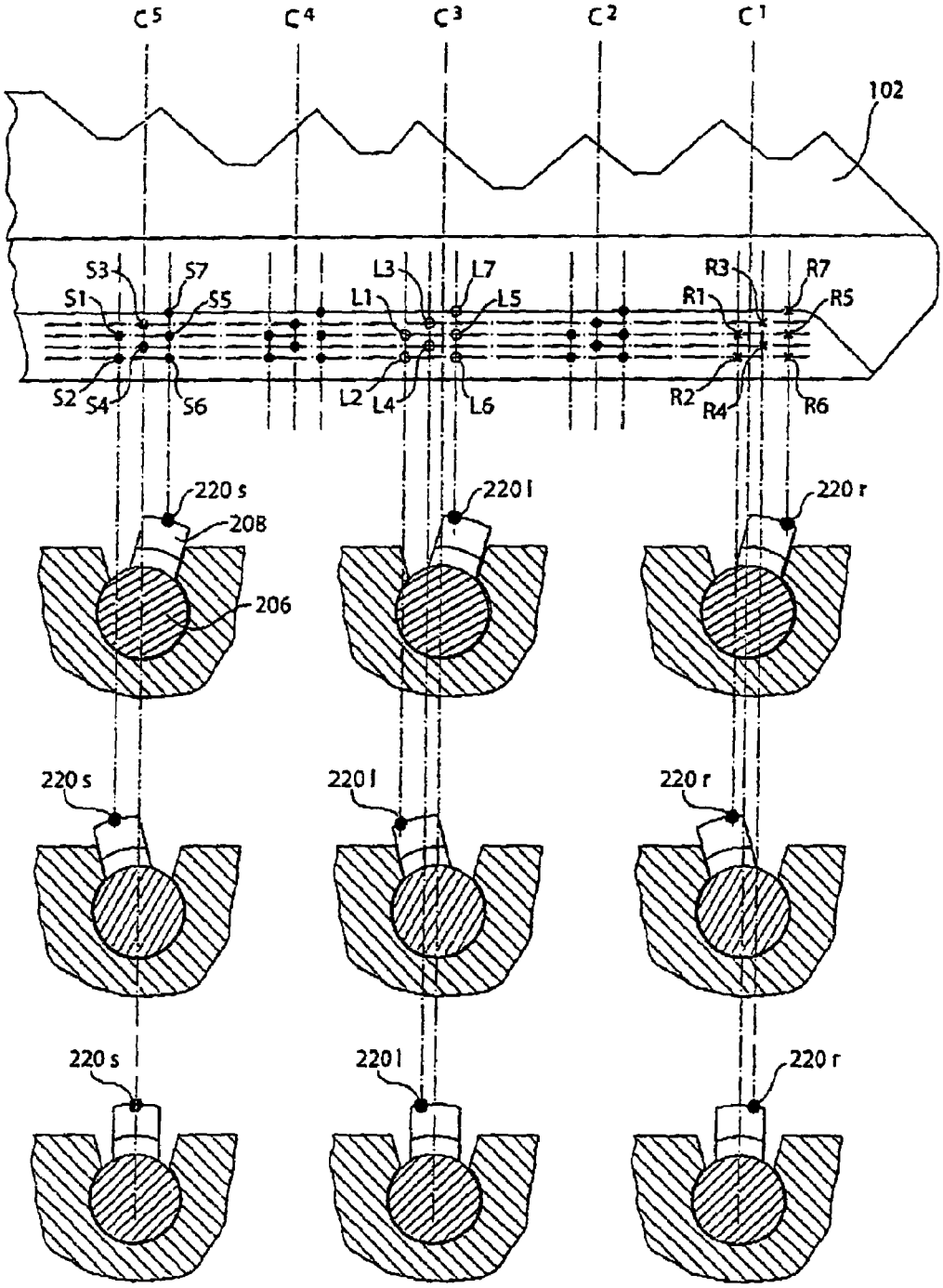
FIG. 5 shows, in a schematic side view, a key blade according to the invention, indicating the locations, represented by black dots, circles and crosses, of possible side code portions for each side locking tumbler.

In FIG. 1, there is shown a cylinder lock and a key included in a system according to the invention. The key 100 has a grip portion 101 and a key blade 102, which is insertable into a key slot 201 of the lock 200. The key slot 201 extends longitudinally in a key plug 202 which is rotatably journalled in a cylindrical bore 203 in a housing 204.

In the illustrated embodiment, the key blade 102 (or a key blank having a side material region to be subsequently cut so as to form a wave-like code pattern having features to be described below) has a top code pattern with cut out portions 103 at its upper edge, e.g. of a conventional type, cooperating with a central row of locking tumblers 205.

In accordance with the present invention, the key blade (or a key blank where the upper code pattern is not yet cut) is also provided with a side code pattern 105 with side code portions 104 of a special kind, similar to those disclosed in the above mentioned US patents to Widén. This side code pattern is formed by a continuous, generally wave-like guiding surface which cooperates with a row of side locking tumblers 206 (five in the row) when the key blade 102 is inserted into the key slot 201 of the lock 200.

The side locking tumblers 206 are each mounted in an associated chamber 207 (see also FIGS. 2, 3 and 4) for elevational and rotational movement therein. Each side locking tumbler 206 has a cylindrical body portion 206*b* and, at its lower end, a transversely projecting finger 208, which reaches into the key slot 201 and which will perform a pivotal movement when the side locking tumbler rotates in the cavity 207.

Actually, when the key blade is inserted into the key slot 201, the finger 208 of the side locking tumbler will engage with the guiding surface and the code portions 104 of the key blade, so as to cause an elevational as well as a rotational movement back and forth of the side locking tumbler 206.

The side locking tumbler 206 is provided with a pair of recesses 209, 210 in its cylindrical surface at the back part of the cylindrical body portion 206*b* (opposite to the finger 208). One of these recesses, 209, is visible in FIG. 2, and both of them 209, 210 are visible in FIG. 3. Between these recesses 209, 210, there is a bridge portion 211, which fits into a corresponding recess 212 in a side bar 213 serving as a locking means or fence member for the rotatable key plug 202. The side bar 213 is mounted in a slotted recess 214 in the key plug 202 adjacent to the outer cylindrical surface thereof. It is spring-loaded radially outwardly so as to be normally seated in a corresponding groove 215 in the lock housing 204, as shown in FIG. 2. In this position, the side bar 213 will effectively prevent the key plug from being rotated in relation to the housing 204.

However, if and when all the side locking tumblers 206 are correctly positioned, upon inserting a key with a correctly coded key blade 102 into the key slot 201, the bridge portions 211 will align with the associated recesses 212 in the side bar 213, whereby the latter can be moved radially inwards. Such inward movement can be effected by turning the key blade while the latter is located in its fully inserted position, so that the flank portions of the groove 215 displace the side bar radially inwards into the slotted recess 214. Now, the key plug 202 can be rotated within the housing 204, provided of course that any other locking mechanism, such as the central row of locking tumblers 205, is also released.

So, when the key blade 102 is being moved further into the key slot 201, the side locking tumblers 206 will be rotated back and forth, because of the engagement of the fingers 208 with the guiding surface 105 of the key blade 101 and, at the same time, they will also perform a movement upwards and downwards. The finger 208 is subjected to a downwardly directed force and is kept in sliding engagement with the guiding surface 105 by means of a helical spring 216 mounted so as to be compressed between the upper surface of the side locking tumbler 206 and an internal upper wall of the chamber 207 (see FIG. 2).

As appears from FIG. 1, the side code pattern with the code locations 104 is constituted by a generally wave-like guiding surface 105 which includes a ramp surface 106 adjacent to the free end portion 107 of the key blade 102. When the key blade 102 is inserted into the key slot 201, the ramp surface will engage successively with the respective finger 208 of each side locking tumbler 206 and will pivot and lift the latter so that the finger 208 subsequently slides along the wave-like guiding surface 105. In doing so, the finger 208 will follow the wave-like guiding surface 105 upwards and downwards, i.e. elevationally, while following the inclined or sloping surface portions of the guiding surface 105. It will also perform a pivotal or swinging movement back and forth so as to bring about a rotational movement of the side locking tumbler 206.

As shown in FIG. 4, there is a channel 217 leading from the lower part of each cavity 207 into the key slot 201, and the side walls of this channel constitute abutment surfaces 218, 219 which will limit the pivotal movement of the finger 208 in each direction from a central plane. In the illustrated example, the abutment surfaces 218, 219 are located in such a manner that the movement will be limited to 15° in each direction, i.e. the finger can swing back and forth in an angular sector of 30° in this embodiment.

The structure and function of the lock and key described so far is basically previously known from the above-mentioned documents.

As described in the above-mentioned patents, this will provide a code which includes a great number of combinations, since the code involves different elevational positions as well as different pivotal positions for each finger, viz. seven such combinations for each tumbler in the example discussed above (making a total of 7×7×7×7×7=16807 code combinations).

Figure 7A:
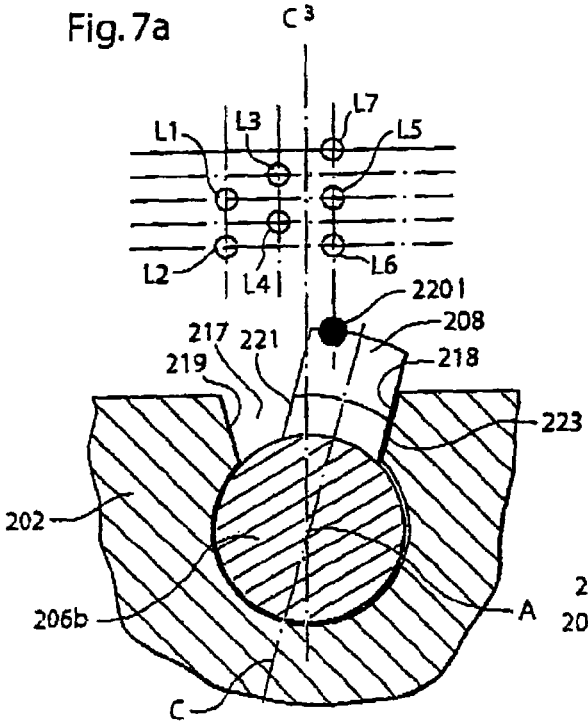
Figure 7B:
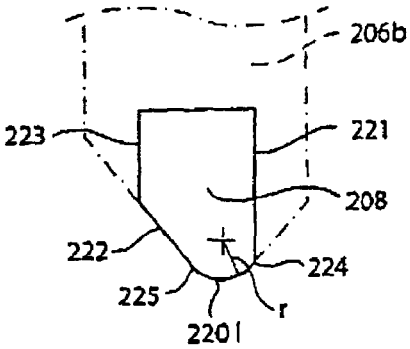
Figure 7C:
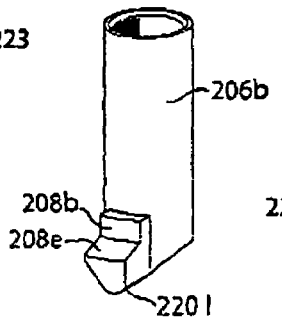
Figure 7D:
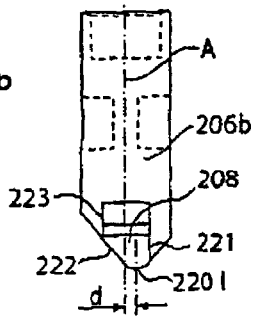
Figure 8A:
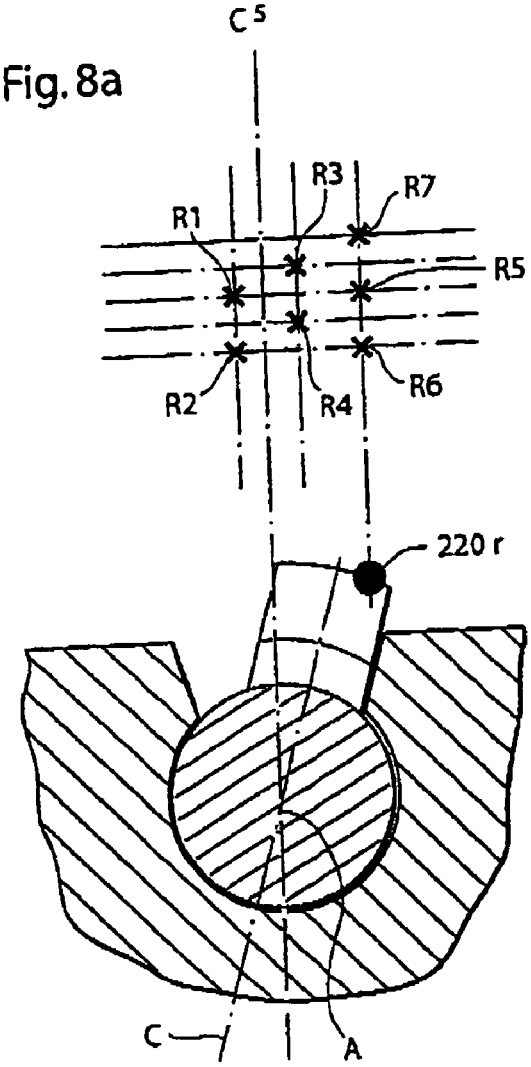
Figure 8B:
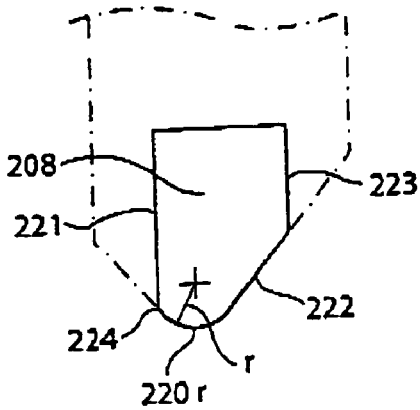
Figure 8C:
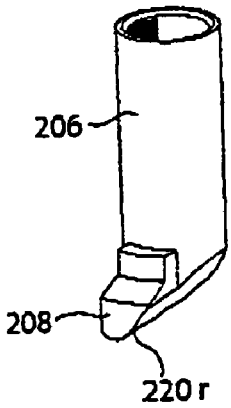
Figure 8D:
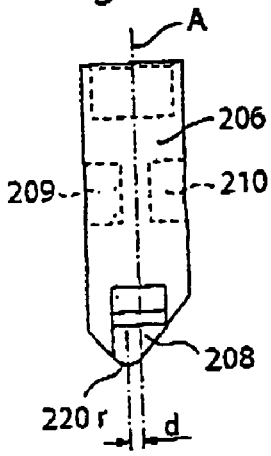

However, in order to provide for an even higher number of code locations and an increased security against copying the key blade and picking the lock, and to provide for master keying, at least one, some or all of the side locking tumblers 206 are provided with a transversely projecting finger 208 having an asymmetrically located key contacting portion 220*r* (or 220*l*), as appears from FIG. 4 but even more clearly from FIGS. 7*d* and 8*d*.

In FIGS. 7*a*,7*b*,7*c*,7*d* the finger 208 is provided with a key contacting portion 220*l* which is asymmetrically located to the left (as seen from above in FIG. 7*a*, see the black dot which schematically illustrates the location of this portion 220*l*). The key contacting portion is cylindrical (see FIG. 7*b*) with a rather small radius r being approximately 0.5 mm. On one side, to the right in FIG. 7*b*, it adjoins a vertical, flat side surface 221 of the finger 208, and on the other side, to the left in FIG. 7*b*, it adjoins an oblique, flat surface portion 222, which in turn adjoins an oppositely located side surface 223 of the finger 208. The cylindrical surface 220*l* adjoins the side surface 221 at a corner 224, whereas it merges smoothly with the oblique surface 222 at a point 225. When the finger 208 is located in its respective pivotal end position, the respective one of the opposite, vertical side surfaces 221, 223 of the finger 208 will abut an associated one of the two opposite abutment surfaces 219 and 218 (FIG. 7*a*), which define the associated channel 217 extending from the chamber 207 to the key slot 201 (see FIG. 4). Alternatively, the pivotal end positions of the finger 208 may be defined by other stop means (not shown) which will limit the rotational movement of the cylindrical body portion 206*b* of the side locking tumbler 206.

Similarly, as shown in FIG. 8*a*,8*b*,8*c*,8*d*, the finger 208 is provided with an asymmetrically located key contacting portion 220*r* which is displaced to the right (see the black dot in FIG. 8*a*) as seen from above. This asymmetric key contacting portion 220*r* is likewise cylindrical with a radius r=0.5 mm and adjoins vertical, opposite side surfaces 221, 223 via a corner 224 and via an oblique surface portion 222, respectively. So, the finger 208 of FIGS. 8*a*,8*b*,8*c*,8*d* is a mirror version of the finger 208 of FIGS. 7*a*,7*b*,7*c*,7*d*.

The key contacting portions 220*r* and 220*l* of the fingers 208 extend from the free end portion 208*e*, along the lowermost portion of the finger and almost, but not quite, all the way to the region of the central axis A of the cylindrical body portion 206*b* of the side locking tumbler 206. Compare also FIGS. 2 and 4.

The key contacting portion 220*r*, 220*l* is displaced from a central plane C (FIGS. 7*a*,7*d*; 8*a*,8*d*) through the axis A of the cylindrical body portion 206*b* of the tumbler 206 and centrally through the transversely projecting, pivoting finger 208. The distance between this central plane C and the key contacting portion 220*r*, 220*l*, respectively, is denoted "d" in FIGS. 7*d* and 8*d*. The lowermost, linear part of the key contacting portion 220*r*, 220*l* may extend along a radius from the central axis A to the tip of the finger 208, or in parallel to the above-mentioned central plane C.

In order to ensure that the distance d is as large as possible, to obtain clear and distinct differences between the symmetric and asymmetric embodiments of the various fingers 208, the radius r defining the key contacting portion 220*r*, 220*l* in the asymmetric embodiments should be as small as possible while still securing a good sliding contact with the wave-like code pattern 105 of the key blade 102 (FIG. 1). In practice, it has turned out that a radius of 0.4 to 0.6 mm, in particular about 0.5 mm, is optimal. In the symmetric version (FIG. 6*b*), on the other hand, the radius R may be somewhat larger, viz. 0.7-0.8 mm, in particular about 0.75 mm.

In the asymmetric embodiments (see FIGS. 7*b* and 8*b*), the key contacting portions 220*l*, 220*r* are located so close to the respective vertical side surface 221 of the finger 208, that there is a corner 224 rather than a smooth merger of these two surface portions. However, this linear corner 224 will not engage with the wave-like code pattern 105 of the key, so there will not be any wear because of this geometrical configuration.

The significance of the asymmetrical key contacting portion 220*r* or 220*l* of the finger 208 will now be explained with reference to FIGS. 5 through 8.

In FIG. 5, there is shown a key blade 102 of the kind shown in FIG. 1. The equidistant locations of the axes of the five side locking tumblers are indicated schematically with dash-dotted lines C1, C2, C3, C4, and C5. In the lower part of this drawing figure, there are shown side locking tumblers 206 having fingers 208 with symmetrically located key contacting portions 220*s* (to the left), left asymmetrical key contacting portions 220*l* (middle) and right asymmetrical key contacting portions 220*r* (to the right). These three side locking tumblers are shown in three different pivoting positions, viz. pointing to the right (upper row), pointing to the left (mid row) and pointing at right angle into the key slot (lower row).

On the key blade, the various code portions (defined by concavities in the wave-like code pattern and uppermost top code segments) are schematically illustrated by filled dots S1,S2,S3,S4,S5,S6,S7 (for the finger with the symmetrically located key contacting portion 220*s*), by open small circles L1,L2,L3,L4,L5,L6,L7 (for the finger with the left asymmetric key contacting portion 220*l*) and by small crosses R1,R2, R3,R4,R5,R6,R7 (for the finger with the right asymmetric key contacting portion 220*r*). All these 21 code portions are shown in FIG. 6*a*, in a slightly larger scale, and the code portions L1-L7 (asymmetric left) are shown in FIG. 7*a*, and the code portions R1-R7 (asymmetric right) are shown in FIG. 8*a*.

Figure 6A:
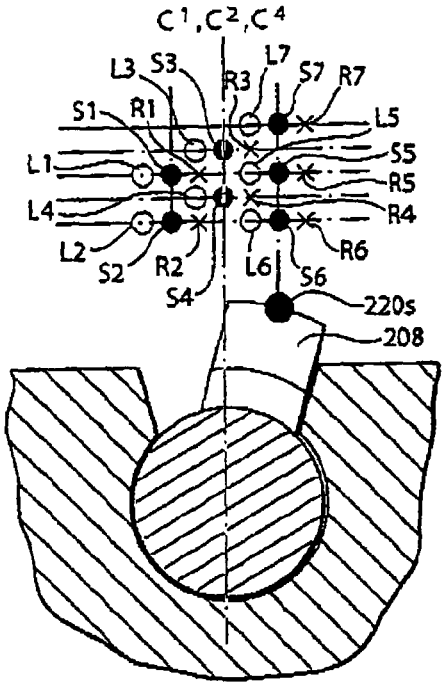
FIGS. 6*a*,6*b*,6*c*,6*d*,7*a*,7*b*,7*c*,7*d* and 8*a*,8*b*,8*c*,8*d* illustrate, at a larger scale, the side locking tumblers shown in FIGS. 4 and 5, with fingers having key contacting portions located symmetrically (FIGS. 6*a*,6*b*,6*c*,6*d*) and asymmetrically (FIGS. 7*a*,7*b*,7*c*,7*d*,8*a*,8*b*,8*c*,8*d*) at the free end portion of the finger, respectively. Each side locking tumbler is also shown, though in a smaller scale, in a perspective view (FIGS. 6*c*,7*c*, 8*c*) and in a side view (FIGS. 6*d*,7*d*,8*d*) and, at a larger scale, in a view towards the end of the finger (FIGS. 6*b*,7*b*,8*b*).
Figure 6B:
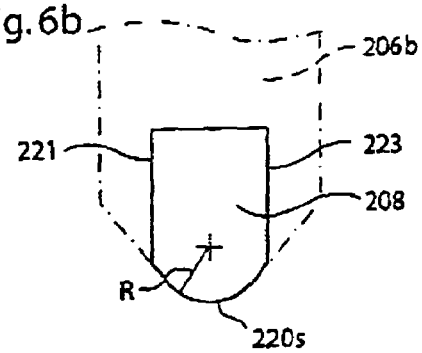
Figure 6C:
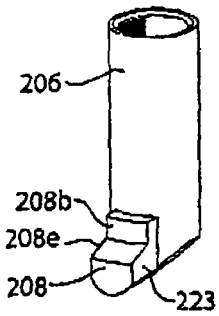
Figure 6D:
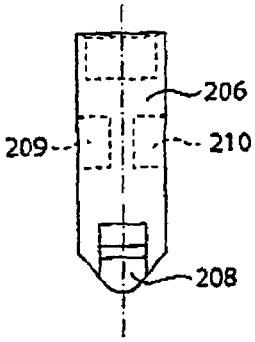

From these FIGS. 5-8 it is clearly seen that the superposition of the three different pivotal positions (the three rows in FIG. 5) and the three different (symmetric, asymmetric left and asymmetric right) locations of the key contacting portion 220*s*,220*l*,220*r* will give rise to a very large number of different code portions or code locations (see especially FIG. 6*a*). It is recognised that all these code portions cannot be used in any arbitrary combination, without discretion, but even so it is apparent that a very high number of possible combinations will be obtained. A conservative assessment would indicate a number of at least 50,000 (for five tumbler locations C1-C5 as shown in FIG. 5), theoretically more than 500,000 or even higher.

Figure 9:
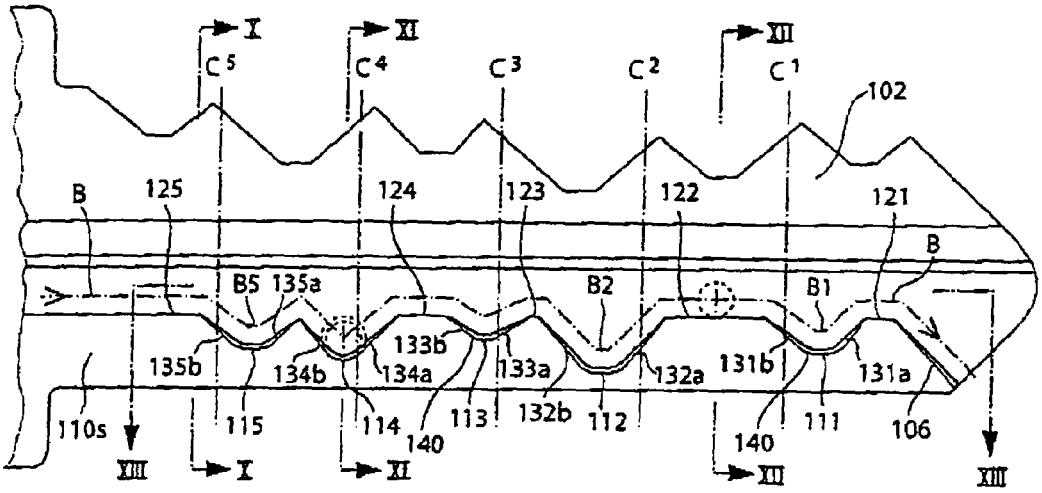
FIG. 9 shows, in side view, a key blade illustrating a method of manufacturing the same with a cutter pin.
Figure 10:
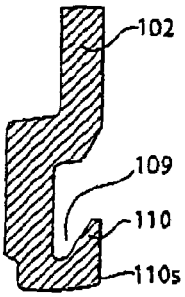
FIG. 10 shows a cross-section of the key blade of FIG. 9, along the line X-X in FIG. 9.
Figure 11:
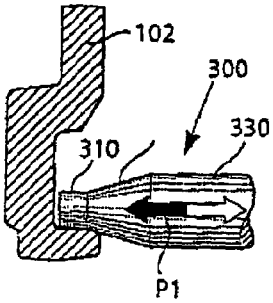
FIGS. 11 and 12 are similar cross-sectional views, along the lines XI-XI and XII-XII, illustrating how the cutter pin operates on the key blade when forming a wave-like code pattern.
Figure 12:
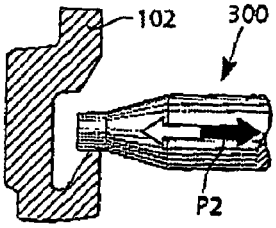

Of course, the key blade associated with a particular lock has to be exactly adapted to the particular combination of side locking tumblers in the lock, including a very high number of possible code locations (FIG. 6*a*) for each side locking tumbler position C1,C2,C3,C4,C5 (FIG. 5). In order to make such a precise wave-like code pattern on the key blade 102 (see FIG. 1), a special cutting method is used according to the present invention. FIGS. 9 and 10 illustrate a typical key blade 102 according to the invention (in side view and in a cross-sectional view, respectively), whereas FIGS. 11 and 12 show a corresponding cross-section of the key blade when it is being machined with a cutter pin in accordance with the inventive method for cutting the wave-like code pattern on a side of the key.

In this particular embodiment, the profile of the key blade includes an undercut side groove 109 of the kind disclosed in the above-mentioned U.S. Pat. No. 5,715,717 (Widén). The wave-like code pattern is cut out in the upwardly tapering lip portion 110 (FIG. 10) formed by the undercut portion of the groove 109. However, it should be pointed out that the invention is not limited to such a configuration of the key blade with an undercut groove.

Figure 13:
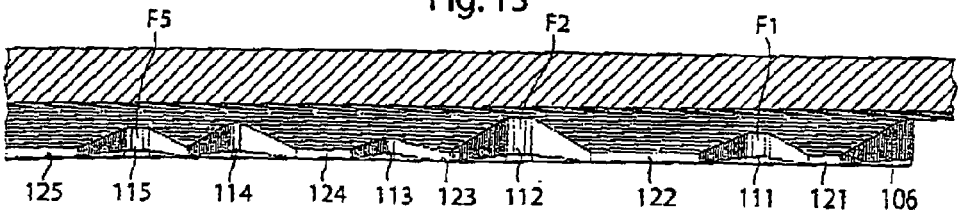
FIG. 13 shows the key blade of FIG. 9 in a view from above.

According to the present invention, the cutter pin is guided, by numerical control, along a predetermined path B while being maintained with its axis in a direction which is perpendicular to the plane of the key blade 102. The path B will thus exactly follow the intended configuration of the wave-like code pattern on the key blade, including the linearly sloping ramp portion 106, a number of concave bottom portions 111, 112,113,114,115, each located adjacent to a side locking tumbler location C1,C2,C3,C4,C5, a number of linear top segments 121,122,123,124,125, and two linearly sloping portions 131*a*,131*b*; 132*a*,132*b*; 133*a*,133*b*; 134*a*,134*b*,135*a*, 135*b* on each longitudinal side of each concave bottom portion. According to the present invention, the path B includes horizontal, linear portions B1, B2, B5 corresponding to at least some of the concave bottom portions, at least for those concave bottom portions located deep down towards the bottom edge 108 (see FIGS. 1, 9 and 10) of the key blade 102. Consequently, see also FIG. 13 where the wave-like code pattern is visible in a view from above, these concave bottom portions 111,112,115 will have a substantially rectangular, flat bottom surface portion F1,F2,F5.

With this configuration of the concave bottom portions, including the substantially rectangular, flat bottom surface portions, the fingers 208, with their free end portions possibly having an asymmetrically located key contacting portion 220*l*, 220*r* (see FIGS. 7*b* and 8*b*), will be permitted to extend into these bottom code portions even when oriented in a pivotal end position (see e.g. FIG. 8*a*) and still contact the lowermost rectangular, flat bottom surface portion, e.g. F1, along the whole or major part of the linear key contacting portion.

Accordingly, the flat bottom surface portions F1,F2,F5 will give a good support for the finger 208 upon being positioned so as to be seated in an associated one of the code portions L1,L2,L5,L6,L7, R1,R2,R5,R6,R7, S1,S2,S5,S6,S7 (in a pivoted position +15° or −15° as illustrated in the upper and middle rows of FIG. 5).

On the other hand, the concave bottom portions 113 and 114 (FIGS. 9 and 13) of the wave-like guiding surface correspond to a finger being positioned perpendicularly to the key blade 10 (as illustrated in the key lower row of FIG. 5), where it is held in a precise, well-defined position.

In a pivotal, lowermost position of the finger 208, the finger will normally bear with one of its vertical side surfaces 221, 223 against an associated abutment surface 219, 218 in the channel 217 of the lock, and with the other vertical side surface 223, 221 or the cylindrical key contacting portion 220 adjacent to the oblique surface 222, where the sloping portion, e.g. 131*b* of the wave-like code pattern adjoins the flat bottom portion 111. With such support from both sides, the finger will be securely held in a well-defined fixed position in the concavity, so that the body portion 206*b* of the side locking tumbler will be correctly position with its rear recesses 209, 210 and the bridge portion 211 exactly located so as to register with the side bar 213 (see also FIGS. 1-4).

In order to reduce the wear of the key and the locking tumbler fingers 208, the concavities and the adjoining sloping portions of the wave-like code pattern are preferably provided with a bevelled surface portion 140 adjacent to the planar outer side surface 110*s* of the key blade 102. The bevelled surface portion 140 is formed by the means of the cutter pin 300 (see FIGS. 11 and 12), which comprises a cylindrical end portion 310, a conical portion 320 and a shaft portion 330. If the cutter pin is inserted axially (arrow P1, FIG. 11) with its conical portion into engagement with the material of the key blade at the lip portion 110, a bevelled surface will be formed. However, it is preferred to avoid a very sharp edge at the top of the lip 110, and therefore the cutter pin is withdrawn axially outwardly (arrow P2, FIG. 12) in these regions, so that there will be no bevelled surface portion in the region of the planar, flat top segments 121,122,123,124,125.

Moreover, to obtain a smooth, continuous cutting operation and a smooth configuration of the wave-like code pattern (assume that the cutter pin travels along the path from the left to the right in FIG. 9), the cutter pin 300 is preferably withdrawn gradually (arrow P2, FIG. 12) when it travels upwardly from a concavity along a sloping surfaces 135*a*,134*a*,133*a*, 132*a*,131*a*, whereas it is gradually displaced axially inwardly when it travels downwardly along the sloping surfaces 135*b*, 134*b*,133*b*,132*b*,131*b*. In this way, a gradually changing bevelled surface, as shown in FIG. 9, is obtained. Hereby, the key contacting portion 220*l*, 220*r* or 220*s* of the finger 208 will bear smoothly on the wave-like code pattern, with a linear contact rather than a single point contact. So the wear will be minimized, and the life of the key and the lock will be much longer.

The wave-like code pattern 105 of the key blade 102 will comprise an inner surface portion, which is perpendicular to the plane of the key blade, and an outer bevelled surface. The inner surface portion will be very important and useful, if the lock is provided with different kind of side lock tumblers, including tumblers with pivoting fingers having an asymmetric key contacting portion, and other tumblers which are non-rotatable and are provided with fixed fingers engaging with the code pattern. The latter, fixed fingers will then engage with the inner surface portions of the code pattern, whereas the pivoting fingers will engage with the outer bevelled surface portions of the code pattern in the region of the concavities and along the sloping portions.

Accordingly, the cutter pin is guided along the path B, while being displaced axially inwardly and outwardly along the sloping portions of the wave-like code pattern.

Figure 11A:
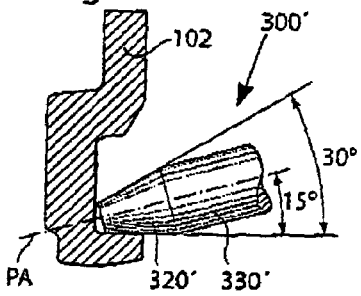
FIGS. 11*a* and 12*a* illustrate a modified embodiment of the cutter pin.
Figure 12A:
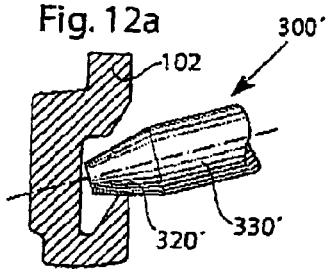

A modified (and somewhat simpler) embodiment of the cutter pin 300' is shown in FIGS. 11*a* and 12*a*. The modified cutter pin 300' includes a conical end portion 320' and a shaft portion 330'. The conical angle of the end portion 320' is, in the illustrated embodiment, 15° and the pin axis PA is held at a corresponding angle (15°) relative to a horizontal plane (perpendicular to the key blade 102). In carrying out the method the concave bottom portions of the wave-like code pattern will be substantially horizontal, without any bevelled surface portion, whereas the sloping portions will be bevelled entirely with a corresponding angle (15°) The top code segments will be flat and horizontal, just like the bottom portions.

Figure 14:
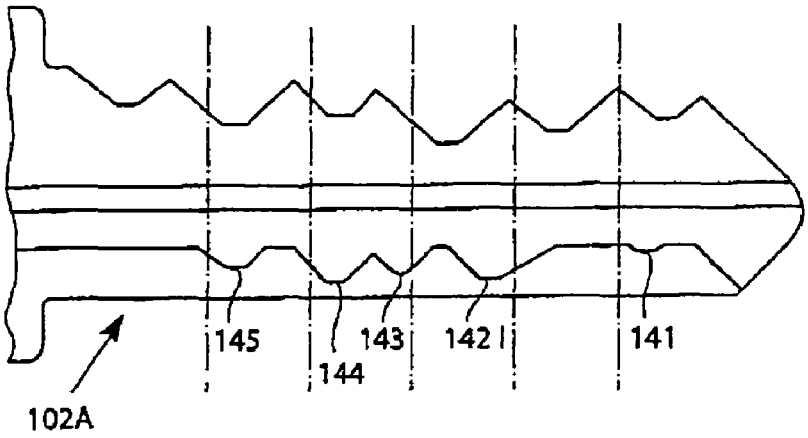
FIG. 14-16 show various key blades illustrating the use of keys with specific codes and a master key.
Figure 15:
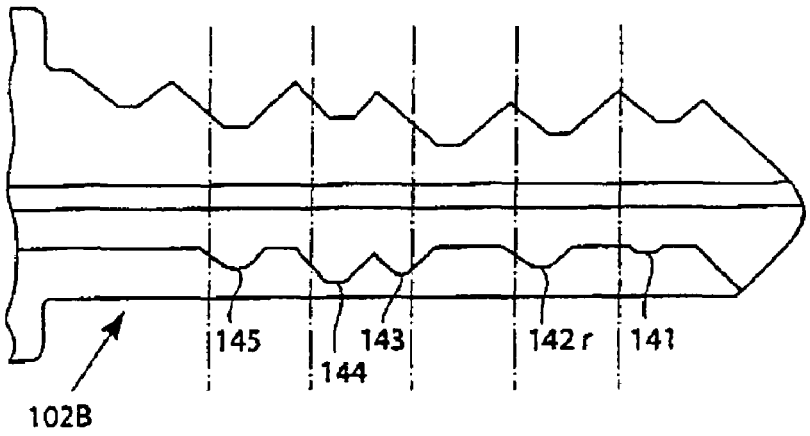
Figure 16:
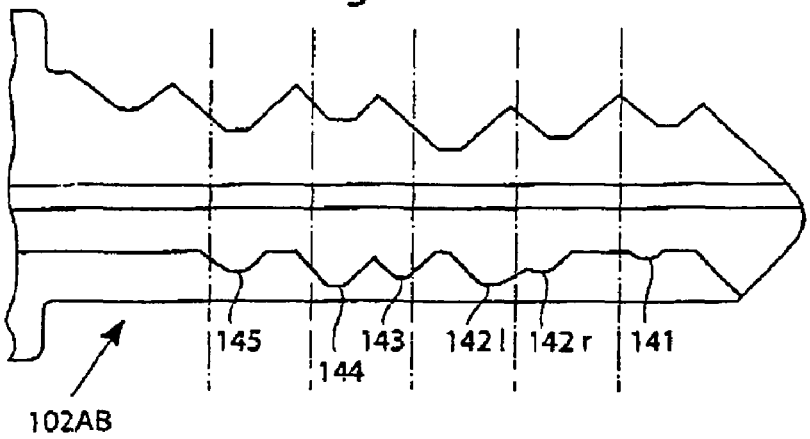

The inventive code pattern and structure of the locking tumblers with fingers having symmetrical or asymmetrical key contacting portions will facilitate the making of master keys for lock and key systems with a number of keys having specific code patterns. Such a system is illustrated in FIGS. 14-16. FIGS. 14 and 15 show two key blades 102A and 102B having similar code patterns with concavities 141,142*l*,143, 144,145 and 141, 142*r*,143,144,145, respectively, the only difference being the concavities 142*l* (cooperating with a left asymmetric key contacting portion) and 142*r* (cooperating with a right asymmetric key contacting portion).

FIG. 16 illustrates a corresponding master key blade 102AB having code portions 141,142*r*,142*l*,143,144,145 and will thus open both locks associated with the keys 102A and 102B.

The lock and key system according to the invention may be modified in many ways by those skilled in the art. For example, not all tumblers in a lock need to be rotatable. The number of side locking tumblers in a row may be different, and the number of code levels may be chosen at will. The number of pivotal positions of the fingers may be less than three, e.g. only two, or more than three, e.g. four or five. The angles of the pivotal end position may be different.

Also, the profile of the key may be varied in many ways and does not have to include an undercut groove. The key blade may have code patterns with a wave-like guiding surface on one side, as shown, or on both sides, cooperating with side locking tumblers arranged on both sides of the key slot. Of course, the side code pattern (or side code patterns) may be combined with any other code or code pattern anywhere on the key blade. It is also possible to provide symmetrical keys which can be introduced in the lock with either side up, and where the code pattern of either side has its "mirror" code pattern on the other side.

Finally, the cross-sectional profile of the key blade may be varied at will, e.g. in accordance with the international patent application PCT/SE2004/001312 (WINLOC et al), the contents of which are induced herein by reference.

The invention claimed is:

1. A lock and key system including a lock comprising:

a housing (204) having a cylindrical bore (203), a cylindrical key plug (202) being rotatably journalled in said cylindrical bore, said key plug having a longitudinal key slot (201) and, at a side of said key slot, a number of side locking tumblers (206) in a row cooperating with a side locking means (213) for locking the key plug against rotation in the cylindrical bore, at least one of said side locking tumblers (206) comprising a cylindrical body portion (206*b*) being mounted in an associated chamber (207) for elevational and rotational movement therein, and a finger (208) which projects transversely from said body portion (206*b*), said elevational movement being performed against the action of a force exerted along said chamber (207), and said rotational movement of the side locking tumbler (206) being caused by a pivotal motion performed by the associated finger (208), the rotational movement of the side locking tumbler (206) being limited between two angular end positions corresponding to a respective pivotal end position of the finger (208), and including a key (100) comprising:

a longitudinally extending key blade (102), which is insertable into said key slot (201) of the key plug (202) of an associated lock (200), said key blade (102) having at a side (110*s*) thereof a side code pattern (105) which forms a wave-like guiding surface including a ramp portion (106) at the free end portion (107) of the key blade, said wave-like guiding surface (105) engaging with said finger (208) of said at least one side locking tumbler (206) and making the finger follow said wave-like guiding surface, the side locking tumbler (206) being caused to move elevationally while being acted upon by said force, and the finger (208) being caused to pivot sideways into specific pivotal positions, when the key blade is fully inserted into the key slot, characterized in that said transversely projecting, pivoting finger (208) of said at least one side locking tumbler (206) includes:

a base portion (208*b*) having two opposite side surfaces (221,223) located at a distance being substantially smaller than the distance between two associated, opposite surfaces (218,219) in a channel (217) extending from said tumbler chamber (207) to said key slot (201), so as to enable a pivoting motion of the finger (208) between said two pivotal end positions, and an asymmetrical free end portion (208*e*) having a key contacting portion (220*r*;220*l*) which is displaced (d), in a circumferential direction, relative to a central plane (C) extending through the central axis (A) of said cylindrical body portion (206*b*) and centrally through said base portion (208*b*) of the finger, whereby the location of said key contacting portion (220*r*, 220*l*) is positioned by way of a specific pivotal position of said finger (208) and a specific asymmetric displacement of said key contacting portion, and the number of possible code combinations is consequently further increased.

2. The lock and key system as defined in claim 1, wherein said two opposite side surfaces (221,223) on the finger base portion (208*b*) are substantially vertical.

3. The lock and key system as defined in claim 2, wherein said two opposite side surfaces (221,223) on the finger base portion are substantially flat.

4. The lock and key system as defined in claim 1, wherein said two associated, opposite surfaces (218,219) in said channel (217) constitute abutment surfaces for defining the pivotal end positions of said finger (208).

5. The lock and key system as defined in claim 1, wherein said key contacting portion (220*r*;220*l*) is formed by a rounded surface portion located asymmetrically between said two side surfaces (221,223) of said finger (208).

6. The lock and key system as defined in claim 5, wherein said rounded key contacting portion (220*r*;220*l*) is cylindrically curved around an axis which is substantially perpendicular to said central axis (A) of said cylindrical body portion (206*b*).

7. The lock and key system as defined in claim 6, wherein said cylindrically curved key contacting portion (220*r*;220*l*) has a radius of curvature of 0.4-0.6 mm.

8. The lock and key system as defined in claim 5, wherein said rounded key contacting portion (220*r*;220*l*) adjoins, on one transversal side thereof one of said opposite side surfaces (221) and, on the other transversal side thereof, an obliquely extending surface portion (222), which in turn adjoins the other one (223) of said two opposite side surfaces.

9. The lock and key system as defined in claim 8, wherein said obliquely extending surface (222) forms an angle of 130-140° relative to said adjoining side surface (223).

10. The lock and key system as defined in claim 9, wherein the key contacting portion (220*r*;220*l*) extends uniformly along the lower side of said finger (208) in parallel to said central plane (C).

11. The lock and key system as defined in claim 1, the lock having at least one further side locking tumbler (206) provided with a projecting finger having at its free end portion an asymmetrically located key contacting portion (220*l*), which is displaced in the opposite direction as compared to the asymmetrically located key contacting portion (220*r*) of the first-mentioned side locking tumbler.

12. The lock and key system as defined in claim 1, wherein all rotatable side locking tumblers (206) have fingers (208) with key contacting portions (220*r*;220*l*) being displaced in the same direction.

13. The lock and key system as defined in claim 1, wherein at least one other side locking tumbler (206) is provided with a finger having a rounded key contacting portion (220*s*) which is located symmetrically between two vertical side surfaces (221,223).

14. The lock and key system as defined in claim 1, wherein the side locking tumbler (206) includes substantially parallel oppositely located side surfaces (221,223).

15. The lock and key system as defined in claim 1, wherein the key blade (102) includes the wave-like code pattern (105) having at least one code portion (104) which is located and shaped so as to accommodate the asymmetrically located key contacting portion (220*r*;220*l*) of the free end portion (208*e*) of the pivoting finger (208) of a side locking tumbler (206) of an associated lock, while the key (100) is being inserted into the lock (200).

16. The lock and key system as defined in claim 15, wherein said code pattern (105) has at least one code portion (L1-L7;Rl-R7) which is positioned by a specific pivotal position of said finger (208) of an associated side locking tumbler (206) and a specific displacement (d) of said key contacting portion (220*l*;220*r*) at said finger.

17. The lock and key system as defined in claim 16, wherein said at least one code portion includes a concave surface bottom portion (111-115) and adjoining sloping portions(131*a*,131*b*- 135*a*-135*b*).

18. The lock and key system as defined in claim 17, wherein said at least one code portion includes a substantially flat top code segment (121-125) located at an upper code level.

19. The lock and key system as defined in claim 17, wherein said concave surface bottom portion (111) is extended in the longitudinal direction of said key blade (102).

20. The lock and key system as defined in claim 17, wherein said concave surface bottom portion (111) has a substantially rectangular configuration (Fl), adjoining smoothly to an associated one of said sloping portions (131*a*, 131*b*).

21. The lock and key system as defined in claim 15, said key blade having an upper edge portion for providing a further code pattern (103).

22. The lock and key system as defined in claim 15, wherein said wave-like code pattern includes two adjacent code portions (142*l*,142*r*) corresponding to two specific code portions (142*l*;142*r*).

23. The lock and key system as defined in claim 15, wherein said wave-like code pattern includes two adjacent code portions (142*l*,142*r*) corresponding to two specific code portions (142*l*; 142*r*) and including a number of keys (102A, 102B) with wave-like code patterns including specific code portions corresponding to said asymmetrical key contacting portion (220*l*; 220*r*) of a tumbler finger (208), and at least one master key (102AB) having a wave-like code pattern including two adjacent code portions (142*l*,142*r*) corresponding to at least two of said specific code portions.

24. The lock and key system as defined in claim 7, wherein said cylindrically curved key contacting portion (220*r*;220*l*) has a radius of curvature of about 0.5 mm.

* * * * *

UNITED STATES PATENT AND TRADEMARK OFFICE

CERTIFICATE OF CORRECTION

PATENT NO. : 7,665,336 B2
APPLICATION NO. : 11/294495
DATED : February 23, 2010
INVENTOR(S) : Widen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 486 days.

Signed and Sealed this

Nineteenth Day of October, 2010

David J. Kappos

David J. Kappos
*Director of the United States Patent and Trademark Office*